US005230163A

United States Patent [19]

Lease

[11] Patent Number: 5,230,163

[45] Date of Patent: Jul. 27, 1993

[54] WEIR GATE ASSEMBLY

[75] Inventor: Daniel T. Lease, McHenry, Ill.

[73] Assignee: General Kinematics Corporation, Barrington, Ill.

[21] Appl. No.: 689,954

[22] Filed: Apr. 23, 1991

[51] Int. Cl.[5] ..... F26B 17/00

[52] U.S. Cl. ..... 34/57A; 432/58; 34/164

[58] Field of Search ..... 34/164, 57 R, 57 A, 34/57 B, 57 C, 10; 432/58

[56] References Cited

U.S. PATENT DOCUMENTS 3,900,958 8/1975 Bongert et al. ..... 34/164
4,305,210 12/1981 Christensen et al. ..... 34/164 X

*Primary Examiner*—Henry A. Bennet

*Attorney, Agent, or Firm*—Wood, Phillips, VanSanten, Hoffman & Ertel

[57] ABSTRACT

A weir gate assembly includes a substantially rectangular weir gate immersed in a fluidized bed of material with a pair of resilient links rotatably connecting the weir gate and the material conveying trough through which the flow travels. A rotatable arm is pivoted on the housing and is connected to the weir gate such that rotation of the arm varies the configuration of the weir gate within the fluidized bed of material. Rotation of the arm forces a lower weir edge into sealed engagement with the conveying trough and deforms the links such that the relationship of an upper weir edge to the lower weir edge is varied to regulate the depth of the flow. A guide slot with a clamp bolt is provided for guiding rotation of the rotatable arm and maintaining the configuration of the weir gate.

32 Claims, 8 Drawing Sheets

WEIR GATE ASSEMBLY

BACKGROUND OF THE INVENTION

1. Technical Field

The present invention is directed toward weir gates, and more particularly toward adjustable weir gate assemblies for independently regulating the flow of a fluid medium at discrete points along a fluid conveying trough.

Weirs for controlling a flow are old in the art, and generally involve placing a dam across a river or canal to raise or divert the water, as for the fast-moving stream of water that drives a mill wheel or to regulate the flow. These structures typically comprise a fence or wall or similar structure which is immersed within the flow.

2. Background Art

In the preparation of certain bulk pulverant materials, it is often desirable to convey a volume of the materials between a number of locations while the material is being treated. To this end, conveyors having an elongated trough with vibration generation means for producing forces to advance the material between the remote locations have been developed by the assignee of the Applicant, as in U.S. Pat. Nos. 3,089,861; 3,898,227; and the like. Together with moving the material along the trough by use of vibration generating means, certain pulverant materials are fluidized by forcing air or other gases upward through the material, creating a moving fluidized bed of material. Where the fluidized material requires various forms of working prior to delivery to a remote location, assorted fluid working implements are positioned along the trough at discrete fluid working zones or stations. As the fluidized bed of material moves along the trough it passes through a work station, at which point the appropriate work is performed thereon.

The preparation and treatment of high volumes of fluidized materials requires the continuous operation of a fluid conveyor to achieve a profitable production efficiency. As a result, the rate at which the material is conveyed along the trough establishes the amount of time at which a particular element of fluidized material is subjected to working at a particular station. A critical deficiency arises, therefore, in situations in which it is required to work the fluidized material for different amounts of time at the various work stations. Because the material travels along a common conveyor, the material travels through each work station at the same rate. While the conveyance rate may allow for adequate working of the fluidized material at some stations, for working steps which require an increased amount or a decreased amount of working time, the fluidized bed of material is improperly worked.

This represents a significant problem. If the rate of conveyance is reduced to increase the amount of time at which the material is worked at otherwise insufficiently worked stations, the otherwise properly worked material will thus be overworked. An analogous situation results if the rate of conveyance is increased. While the amount of time at which the fluidized bed of material is worked at an otherwise overworked station is reduced, the otherwise properly worked material will thus be under worked.

The present invention is directed to overcoming the problems discussed above.

SUMMARY OF THE INVENTION

An object, therefore, of the present invention is to provide an improved weir gate assembly for regulating a flow of material along a flow path within a fluidized bed of material and extending among a plurality of successive work stations.

In the exemplary embodiment of the invention, a weir gate assembly includes a substantially rectangular weir immersed in the fluidized bed with a pair of resilient links rotatably connecting the weir and the fluid conveying trough through which the flow travels. A rotatable arm is pivoted to the fluid conveying trough and can be adjusted to vary the configuration of the weir within the fluidized bed. Rotation of the arm forces a lower weir edge into sealed engagement with the conveying trough and deforms the links such that the relationship of an upper weir edge to the lower weir edge is varied to regulate the depth of the flow. A guide slot with a clamp bolt is provided for guiding rotation of the rotatable arm and maintaining the configuration of the weir.

According to one feature of the exemplary embodiment, the rotatable arm is movable between an operating position in which a portion of the weir is immersed in the fluidized bed to regulate the flow of fluidized material, and an inoperative position in which no portion of the weir is immersed in the fluidized bed of material to facilitate flushing of the conveying trough.

The invention also comprehends a vibratory conveyor for transporting material along a flow path wherein the material is treated to form a fluidized bed and, as the fluidized bed of material is conveyed along the flow path, it passes through a plurality of work stations. The conveyor includes an elongated trough extending between an inlet trough end and an outlet trough end, with the fluid working stations positioned therebetween. A vibratory force generator is mounted on the trough for generating forces sufficient to advance the flow of material from the inlet end of the trough to the outlet end of the trough. A plurality of weir gate assemblies are mounted on the trough for independently regulating the flow of material between successive work stations.

In one aspect of the invention, a plurality of actuators are associated with the weir gate assemblies disposed at the work stations for automatically adjusting the configuration of the weir assemblies.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE INVENTION

Figure 1:
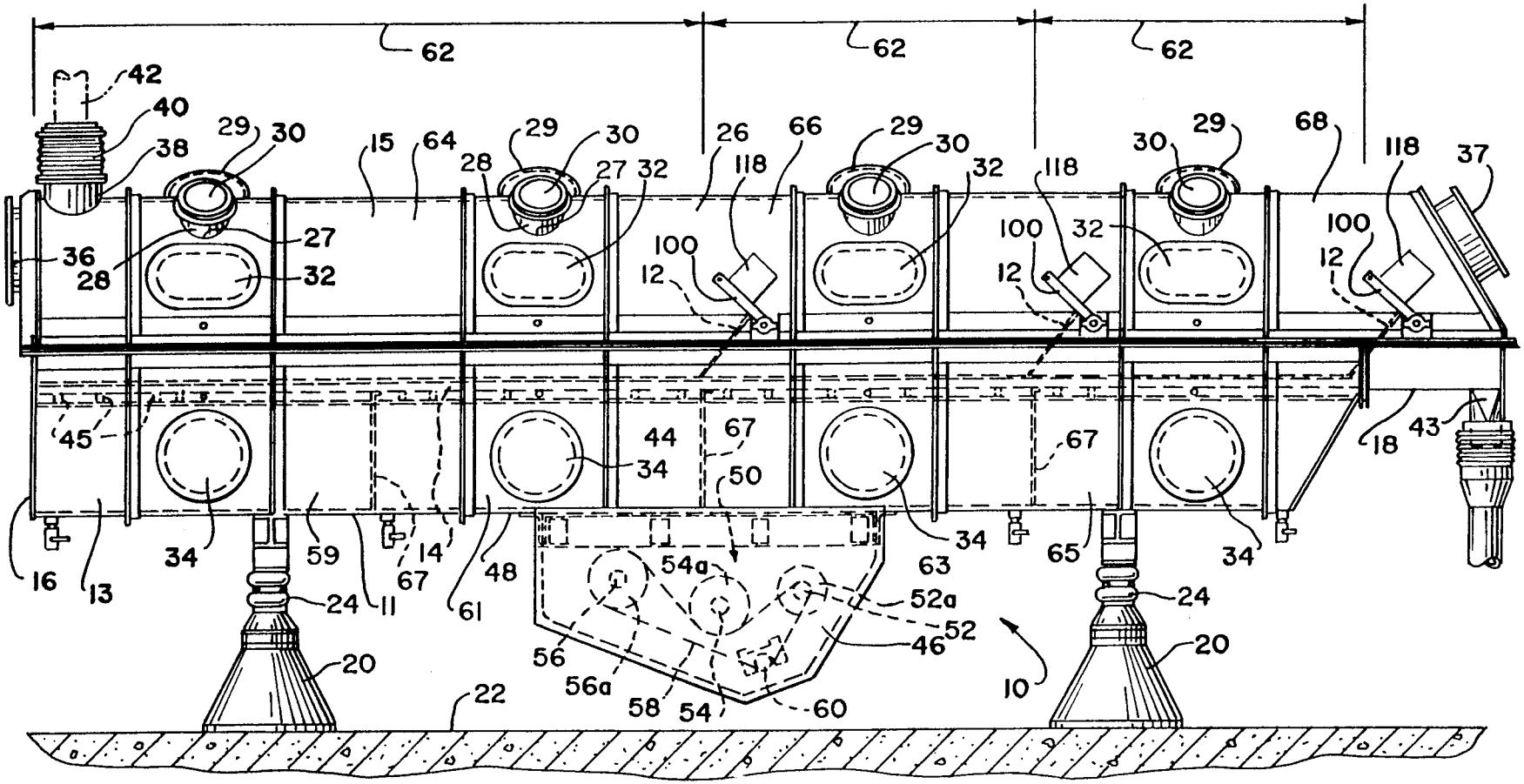
FIG. 1 is front elevational view of a vibratory conveyor having a number of weir gate assemblies embodying the present invention.

Shown in FIG. 1 is a vibratory material handling apparatus generally at 10, in the form of an elongated conveyor and supporting a number of weir gate assemblies 12 embodying the present invention.

So as to understand the environment in which weir gate assemblies 12 operate, vibratory material handling apparatus 10 will be herein described in detail. Vibratory material handling apparatus or vibratory conveyor 10 comprises an elongated housing 13 having a conveyor bottom 11 and a conveyor hood 15. Housing 13 includes an elongated trough 14 and extends between a spaced-apart material inlet end 16 and material discharge end 18. Housing 13 is supported above a base 22 by vertically standing legs 20 disposed near opposite end portions of the trough. Legs 20 include resilient elements, such as inflatable air bags 24, for isolating displacement of housing 13 from base 22.

A number of openings 27 are spaced lengthwise along the outer surface 26 of hood 15 of housing 13. Cylindrical ducts 28 angle upwardly from the openings 27 in hood 15 with observation windows 30 to allow visual inspection of the material within the housing as the material is conveyed from inlet end 16 toward discharge end 18. Exhaust spouts 29 are mounted on hood 15 for releasing vapors developed within the housing 13 during the conveyance process. Additional access panels 32 and 34 are axially spaced along hood 15 and bottom 11, respectively, and are in vertical alignment with exhaust spouts 29 and observation windows 30. Access panels 32 and 34 facilitate the maintenance of the interior of the conveyor. Panels 34 can be used as the access for inlet spouts (not shown) for introducing the fluidizing air into the plenum chambers below the trough for each working station, as will be described hereinafter. Additionally, a manway 36 extends through the housing at the material inlet end 16 and a manway 37 extends through housing 13 at the outlet end 18 to allow further access to the conveyor interior. An inlet chute 38 extends upwardly from material inlet end 16 and terminates in a flexible boot 40 for engaging the distal end of an infeed chute 42. Discharge end 18 has a vertically depending outlet chute 43 for discharging materials from the conveyor.

Mounted at approximately the midline of elongated housing 13 and forming part of trough 14 is a substantially horizontally extending material-supporting deck 44. Deck 44 spans the entire length of trough 14 and is the surface upon which material transported in apparatus 10 is conveyed from inlet end 16 to discharge end 18. Plural openings 45 extend through the main plate of deck 44 through which fluidizing fluid passes.

An enclosure 46 depends from an underside 48 of the conveyor bottom 11 of the housing 13 and houses a vibratory conveying means, such as a belt drive arrangement, generally shown at 50. Drive arrangement 50 comprises a plurality of parallel shafts 52, 54 and 56 having rotatable eccentrics **52*a*, 54*a* and 56*a*, respectively, attached to an outer end thereof. By means of an inextensible belt 58, a motor 60 drives shafts 52, 54 and 56 to rotate the eccentrics and thereby impart a periodic thrust force to underside 48 of elongated housing 13. In a manner shown in my earlier U.S. Patents, drive arrangement 50 is thereby operable to impart vibratory forces along deck 44 of trough 14 to convey material contained thereon from inlet end 16 to material discharge end 18**.

The plenum chamber in the conveyor bottom 11 below the deck 44 is divided into separate zones 59, 61, 63 and 65 by zone plates 67. Each zone 59, 61, 63 and 65 receives air or fluid under pressure through panels 34, with the air passing upwardly through the openings 45 in the deck 44 of trough 14. Each zone or work station can have air or fluid treated to accomplish the work intended in that zone, i.e., heating, cooling, drying, moisturizing, or the like. Spaced above material support deck 44 are a series of discrete working zones, or work stations, designated by vertical dividing lines 69. Horizontal lines 62 (FIG. 1) illustrate the longitudinal extent of each work zone. A material cooling station 64 aligned above zones 59,61 is provided immediately upstream of a first drying station 66 aligned above zone 63, which station 66, in turn, is positioned upstream of a second drying station 68 aligned with zone 65. As material is conveyed or passes through each of the work stations 64, 66 and 68, the associated working implements may be activated to perform an additional appropriate function. Material is continuously transported along the conveyor and sequentially subjected to different working, such as cooling, drying, or the like.

Figure 2:
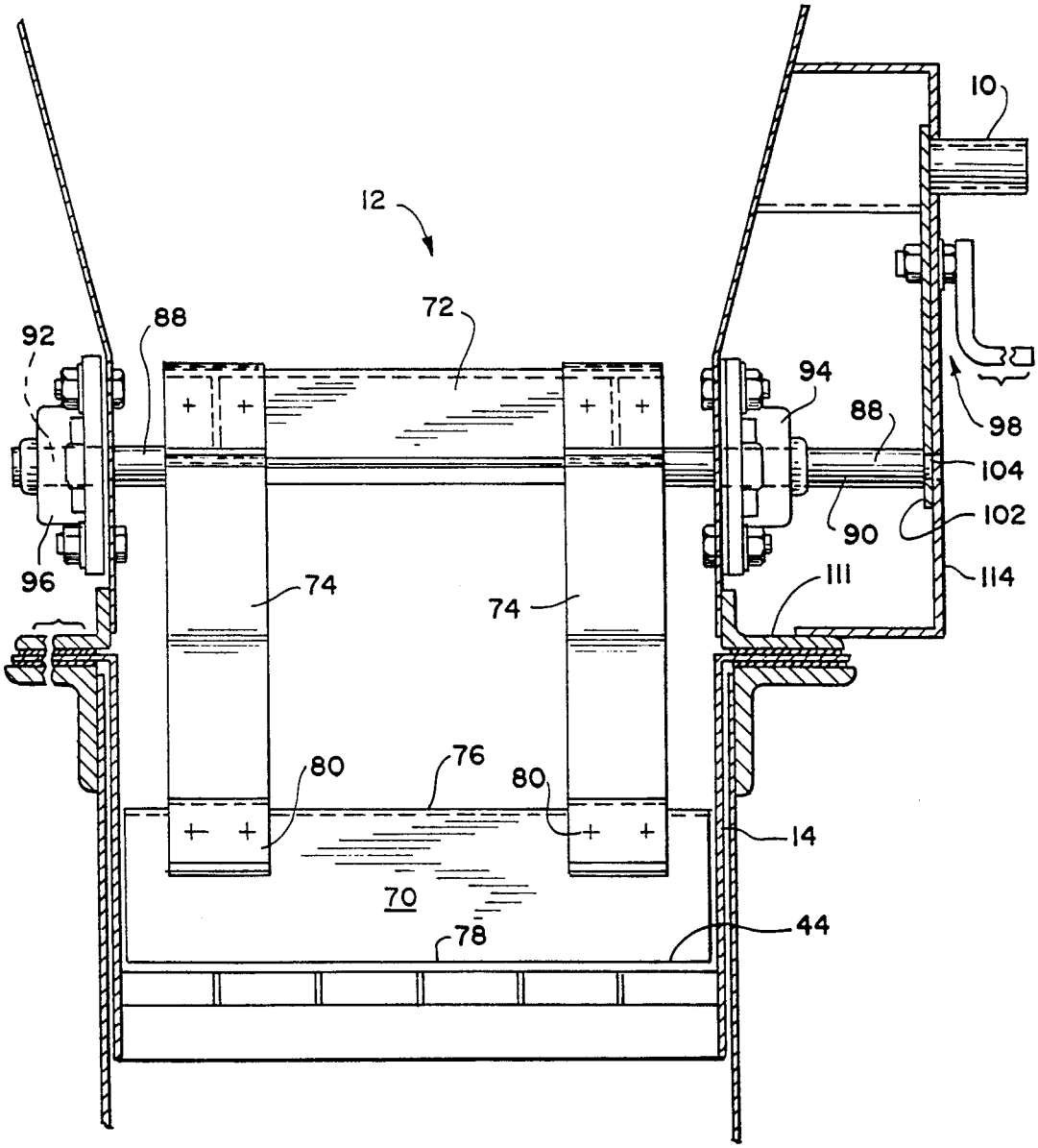
FIG. 2 is an enlarged end-sectional view of the vibratory conveyor shown in FIG. 1 and illustrating a weir gate assembly.
Figure 3:
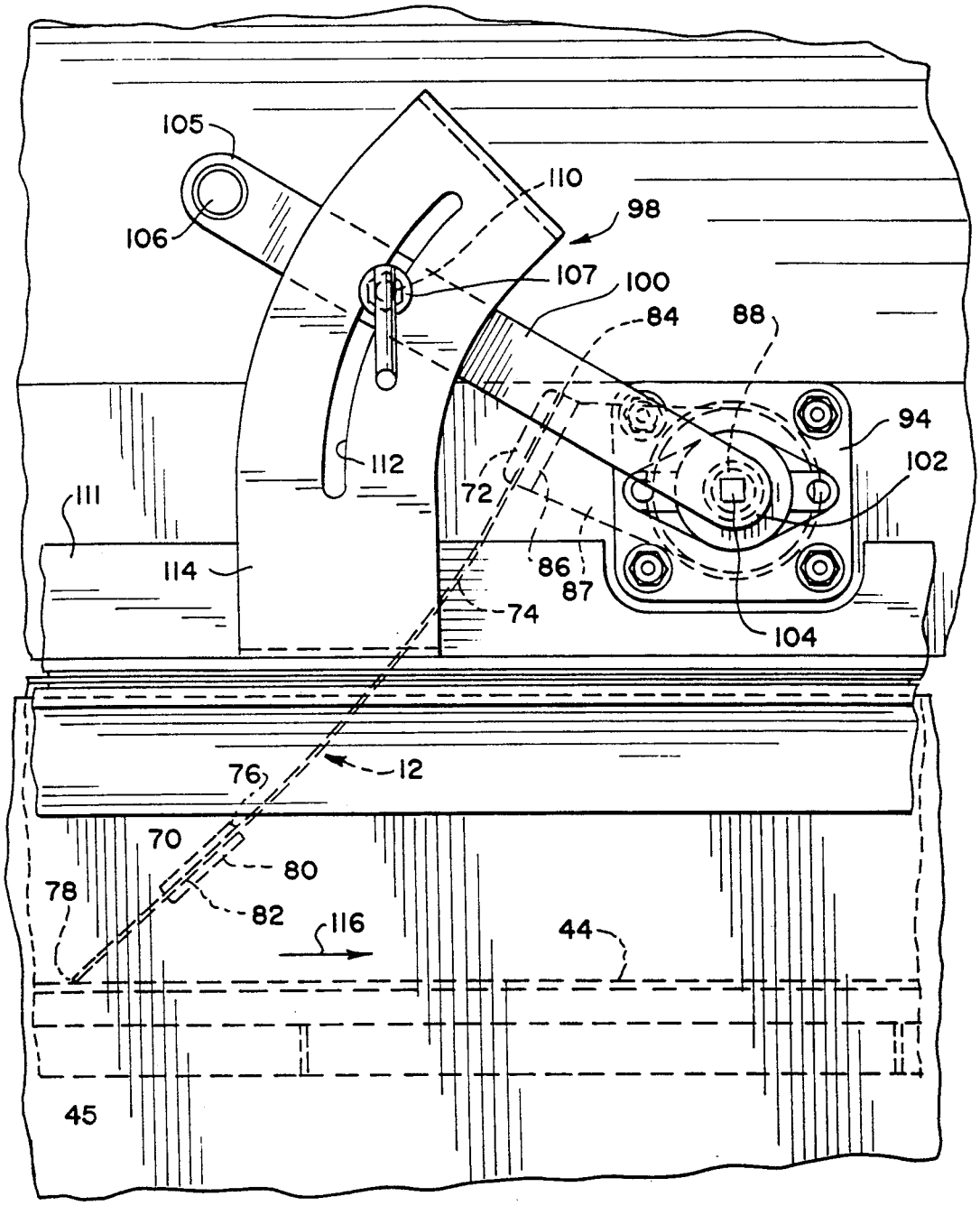
FIG. 3 is an enlarged view of a portion of the vibratory conveyor shown in FIG. 1 illustrating the adjustment arm and guide plate of the weir assembly.

The foregoing description was directed toward the operating environment of the present invention and was provided to facilitate the understanding of the weir gate assemblies discussed herein. Referring first to FIGS. 2 and 3, a weir gate assembly 12 comprises a substantially rectangular weir gate 70 suspended from a connecting arm 72 by means of a pair of spaced-apart resilient links 74. We r gate 70 spans the width of deck 44 of elongated trough 14 and extends vertically between an upper weir edge 76 and a lower weir edge 78. For reasons to be described, weir gate 70 is formed of a resilient material, such as stainless steel.

Resilient links 74 are identical members fixed at a lower portion 82 to the upper portion of weir edge 76 by means of clamp bars 80. As shown in FIG. 3, clamp bars 80 and weir gate 70 sandwich the lower portion 82 of the depending links 74 therebetween. The links are connected at an upper portion 84 of links 74 by similar clamp bars 86 and attached to connecting arm 72.

Connecting arm 72 is supported by spaced-apart brackets 87 on a laterally extending pivot shaft 88 which spans elongated trough 14 and is rotatably connected at spaced-apart opposite ends 90 and 92 to shaft-receiving pivots 94 and 96, respectively, mounted on the outside of trough 14. Shaft end 90 extends outwardly of pivot 94 and rotatably mounts a weir gate adjustment assembly, shown generally at 98.

Adjustment assembly 98 is shown in FIG. 3 to include a radially extending arm 100 mounted at an arm end 102 to a key member 104 on the outward end of shaft 90. The opposite end 105 of arm 100 mounts a handle 106 extending perpendicular to arm 100. A clamping knob 108 extends from a nut 107 threaded on a guide bolt 110 which projects from arm 100 and through an arcuate slot 112 in a juxtaposed guide plate 114. Guide plate 114 is fixed to a bracket 111 on the housing 13 (FIG. 2). Arcuate slot 112 has a constant radius extending radially about the axis of shaft 88. Rotation of handle 106, arm 100 and shaft 88 displaces guide bolt 110 along slot 112 and minimizes bending stresses developed in pivot 94 as force is applied to handle 106. Rotation of clamping knob 108 compresses nut 107 against guide plate 114 and arm 100 to clamp the arm in fixed position, whereby the angular position of arm 100 is maintained until clamping knob 108 is counter-rotated to disengage the arm and guide plate.

As illustrated in FIG. 3, weir gate assembly 12 is normally positioned with weir gate 70 oriented obliquely in relation to the material flow direction, indicated by arrow 116, such that material traveling on deck 44 of trough 14 is directed from lower weir edge 78 toward upper weir edge 76. As arm 100 is rotated in a counterclockwise direction, as viewed in FIG. 3, lower weir edge 78 is forced into sealed engagement with material supporting deck 44 such that no material may pass under weir gate 70. Continued counterclockwise rotation of arm 100 results in the elastic deformation of resilient links 74 such that the relation-ship of the upper weir edge 76 to the lower weir edge 78 is varied. Further rotation of arm 100 also induces deformation of the weir gate itself.

The depth of the fluidized bed immediately upstream of a weir gate assembly is established by the position of upper weir edge 76 relative to the lower edge 78 and hence relative to material support deck 44. The fluidized bed of material travels along the conveyor until the flow path is obstructed by a weir gate. As the fluidized bed of material continues to move toward the retained material at the weir gate, the depth of the fluidized bed begins to increase. Once the bed depth surpasses the distance between the support deck 44 and the upper weir edge, the fluidized bed of material passes over the gate and toward discharge end 18. By positioning a weir gate assembly at the beginning of each work station and appropriately adjusting the weir gate configuration, the depth of the fluidized bed of material at the work station is prescribed. Preferably, the depth is set so as to establish a predetermined amount of time required for the fluidized bed to reach the prescribed depth and to traverse the zone of the working station. This amount of time is calculated to be the desired working time for whatever treatment (i.e. heating, cooling, drying, etc.) is being performed on the material as it traverses the work station.

Figure 4:
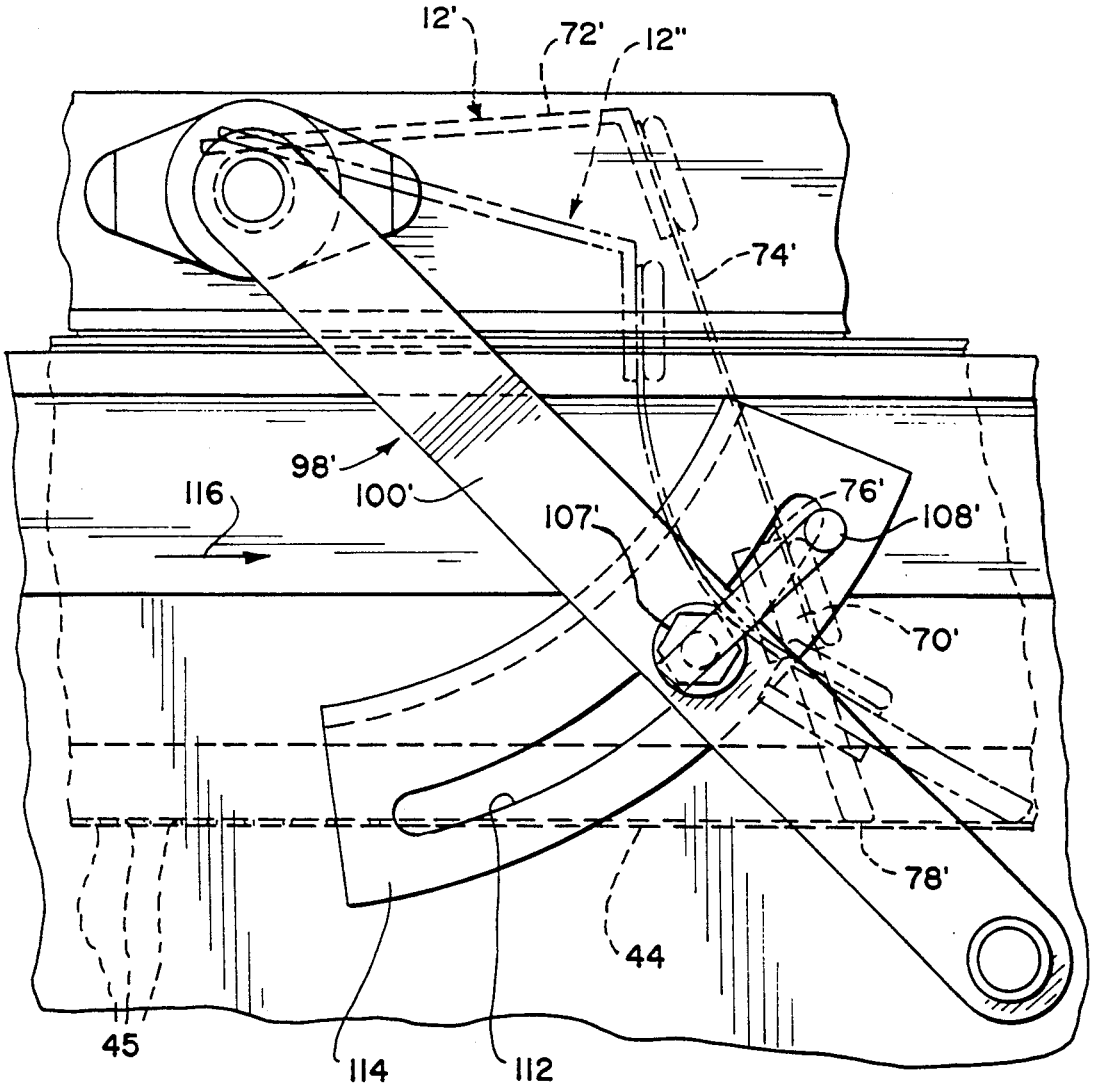
FIG. 4 is an alternative embodiment of the weir gate assembly illustrated in FIG. 3 in both an undeformed and a deformed configuration.

An alternative arrangement of weir gate assembly 12 is shown at 12', in FIG. 4. While embodying the same general elements as the preferred embodiment described above, pivoting connecting arm 72' suspends a weir gate 70' from a pair of resilient links 74' in engagement with underlying deck 44. Weir gate 70' is immersed in a fluidized bed of material supported on deck 44 obliquely to the direction of flow path indicated by arrow 116. Weir gate 70' is inclined away from the direction of the flow path such that material traveling within trough 14 is directed from upper weir edge 76' toward lower weir edge 78'. An analogous weir gate adjustment assembly 98' is provided, having a rotatable arm 100' and an interengaged guide plate 114'. Rotation of arm 100' in a clockwise direction, from dotted line position 12' to the dotted line position 12', in FIG. 4, forces lower weir edge 78' into sealed engagement with deck 44 and elastically deforms resilient link 74' such that the relationship of upper weir edge 76', when positioned with dotted line position 12' to the position with dotted line position 12'', is lowered so that the flow rate thereover is varied.

It is believed the operation of the weir gate assembly and vibratory conveyor will be readily understood from the foregoing description and may be briefly summarized as follows. Material is continuously introduced onto deck 44 in the elongated housing through inlet chute 38, where it is subsequently transported and fluidized by the vibratory motion and by the passage of air or the like upward through the material. The material supporting deck 44 moves the fluidized bed of material to and through each of the work stations and ultimately discharges the material at the discharge end. Energization of the vibratory generator 50 results in the generation of vibratory forces having components in the preferred direction of conveyance of the fluidized bed of material. As the material travels in a path extending among the work stations, the treated air passing upward through the fluidized bed of material to perform a desired operation on the fluidized bed of material. In order to regulate the length of time to which the fluid is subjected to working (i.e., drying, cooling. etc.)at a particular station, the weir gate assemblies are adjusted to appropriately regulate the flow. By rotating the adjustment arms on each weir gate assembly, the vertical distance between the upper weir edge and the material supporting deck can be prescribed to set the depth of the flow at a particular station. As the arms are rotated counterclockwise (FIG. 3) and clockwise (FIG. 4), the resilient links attached to the weir plate are deformed such that the upper weir edge is moved toward the deck, the resilient links are deformed and the upper weir edge is moved toward the deck, thereby setting a lower flow depth at that point. Similarly, rotating the arms away from the deck results in the restoration of the resilient links and the raising of the upper weir edge to set an increased flow depth. By regulating the depth of the flow at various points, the amount of time at which a material is disposed at that point and, hence, subject to working of the type associated with the station at which the material is located, is controlled. Each of the weir gate assemblies may be adjusted to different positions, whereby independently regulated flow depths may be preset.

Figure 5:
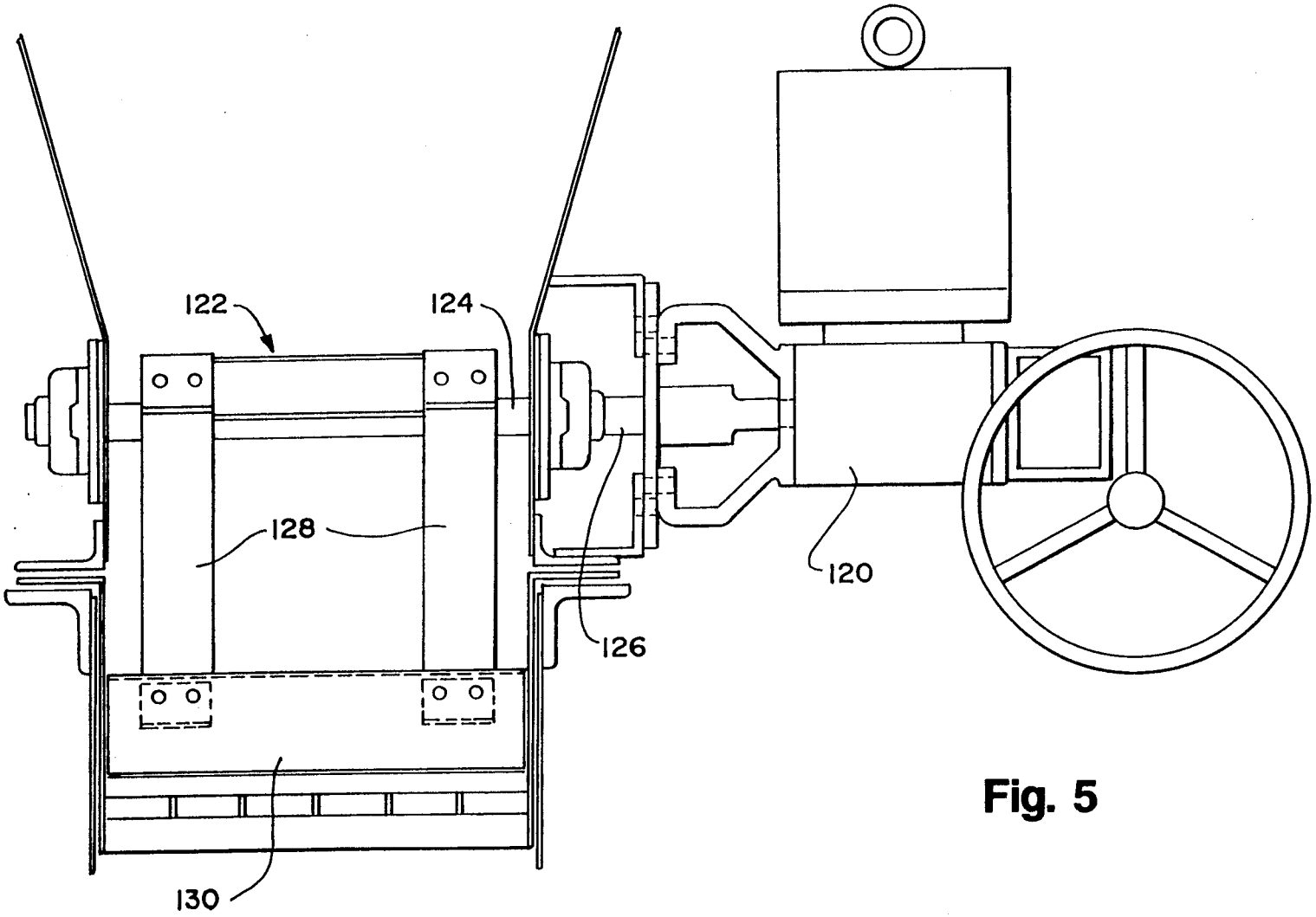
FIG. 5 is an alternative embodiment of the weir gate assembly illustrated in FIG. 3 including a rotary power actuator.

The invention further comprehends the provision of power actuators 118 (shown schematically in FIG. 1) for automatic positioning of arms 100 and regulation of the associated flow depth. The actuators may take the form of either pneumatice, electric, or hydraulic devices. In the form illustrated in FIG. 5, a rotary electro-pneumatic actuator 120 is mounted adjacent a weir gate adjustment assembly 122 and is drivingly engaged with an end 124 of a pivot shaft 126 to effectuate the desired rotation of resilient links 128 and weir plate 130. This construction permits the remote commanding of a preferred flow depth at each of the working stations.

Figure 6A:
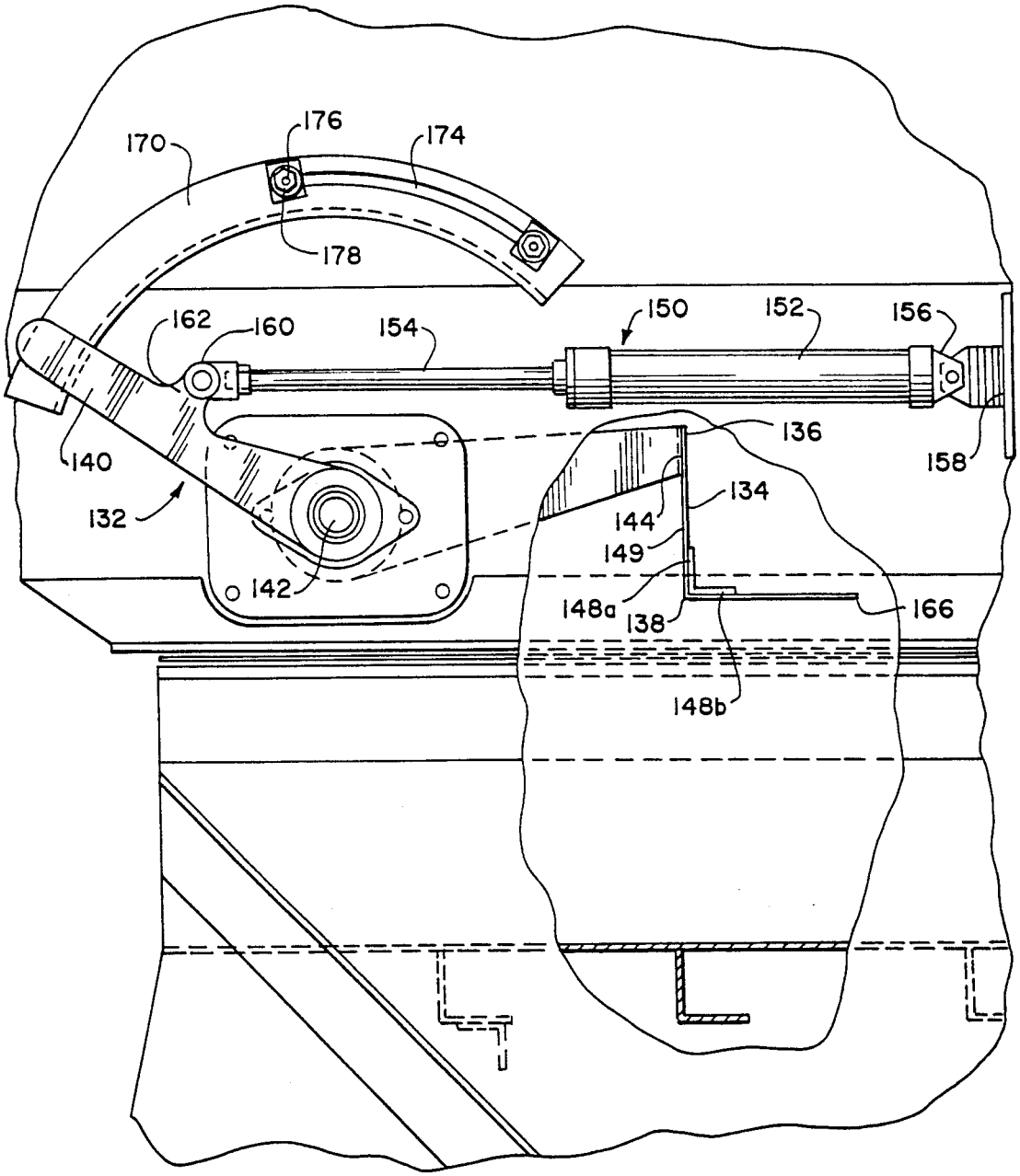
FIG. 6*a* is an alternative embodiment of the weir gate assembly illustrated in FIGS. 3 and 4 in an undeformed configuration.
Figure 6B:
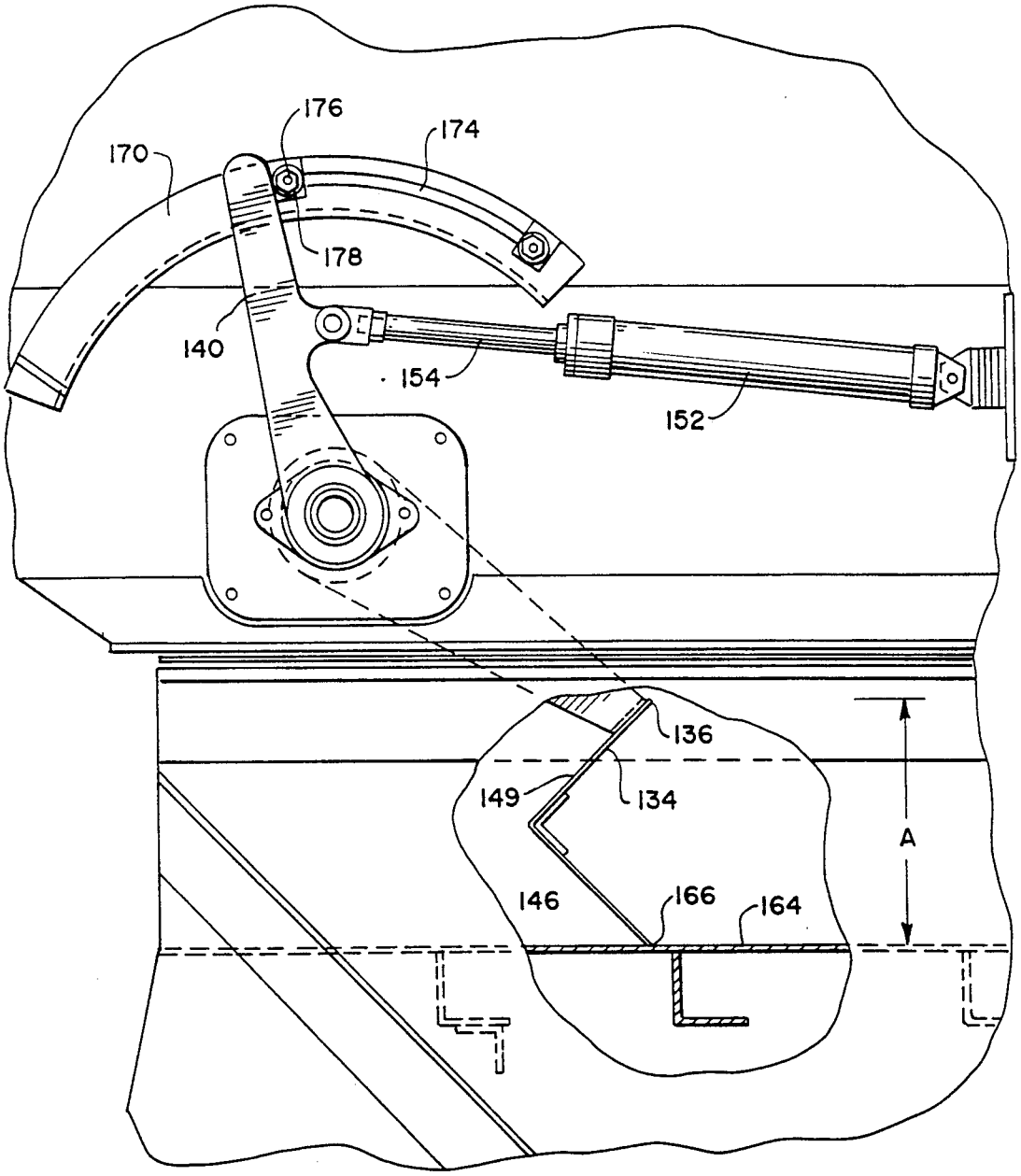
FIG. 6*b* illustrates the weir gate assembly shown in FIGS. 6*a* in an undeformed configuration and defining a maximum fluidized bed depth.
Figure 6C:
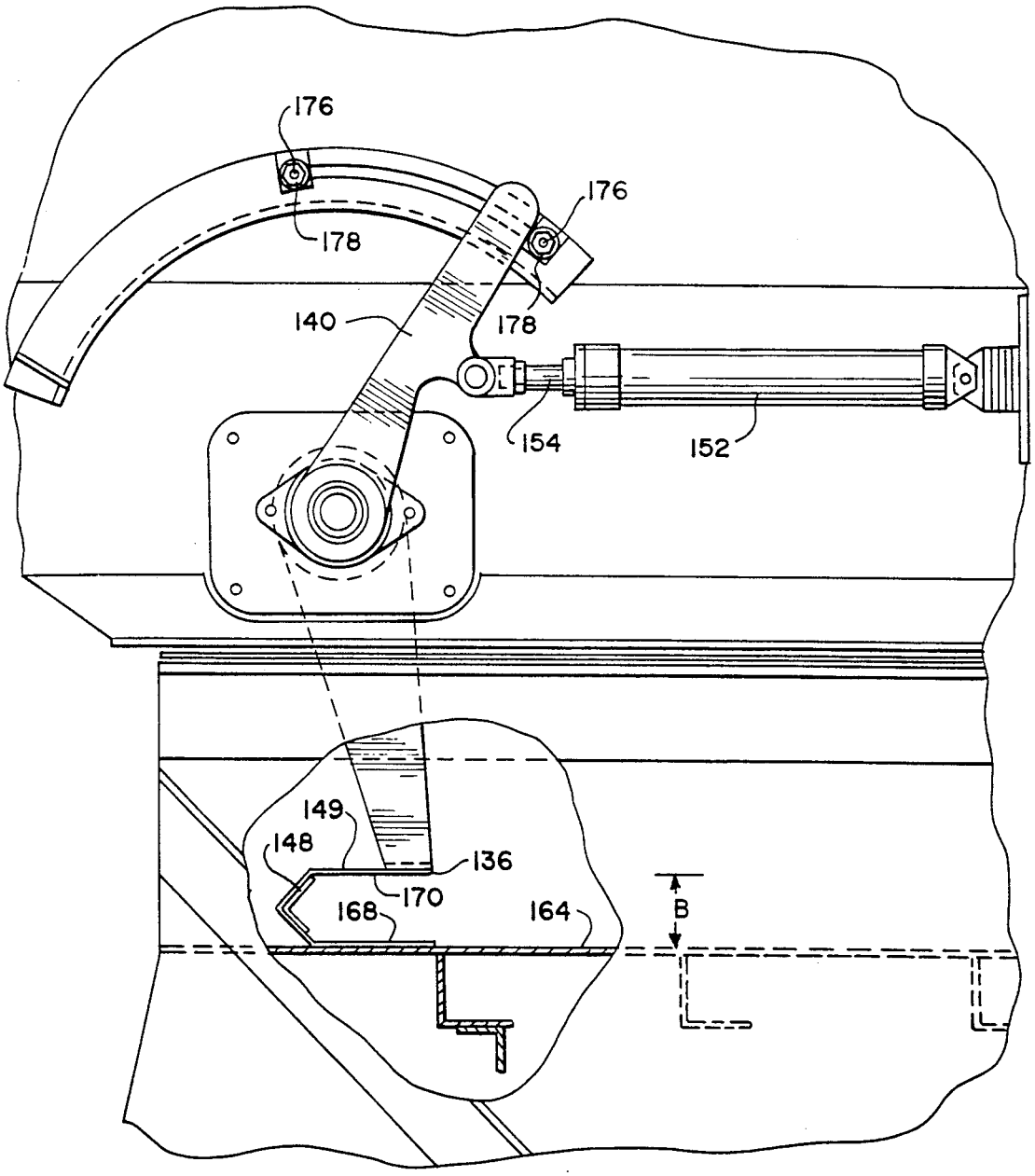
FIG. 6*c* illustrates the weir gate assembly shown in FIGS. 6*a* in an deformed configuration and defining a minimum fluidized bed depth.

An alternative weir gate / actuator assembly envisioned by the present invention is illustrated in FIGS. 6*a*, 6*b*, and 6*c*. A weir assembly, shown generally at 132, comprises a first substantially rectangular plate 134 having an upper edge 136 and a lower edge 138. A pair of spaced-apart radially extending arms 140 (one shown in FIGS. 6*a*–6*c*) are rotatably mounted on a laterally extending shaft 142 and have an end surface 144 engaging the upper edge 136 of plate 134. A second substantially rectangular plate 146 is mounted adjacent the lower edge 138 of plate 134 by means of laterally extending L-shaped flange 148, with plate 134 extending substantially parallel to one leg 148*a* of flange 148, and with plate 146 extending substantially parallel to the other leg 148*b* of flange 148. Each of the plates 134 and 146 is formed of a resilient material, such as stainless steel, and together with flange 148 define a weir gate 149.

A linear power actuator 150 includes a cylinder 152 and a reciprocable piston 154, with an end 156 of cylinder 152 pivoted to a stationary mount 158, and an opposite end 160 of piston 154 pivoted to a projecting tab 162 formed on each rotary arm 140. Actuation of the cylinder 152 is effective to extend and retract the piston 154, whereby arms 140 are rotated about shaft 142 and weir gate 149 is moved toward and away from the trough deck 164.

FIG. 6*a* illustrates the position of weir gate assembly 132 with actuator 150 in a fully extended position, with the weir gate 149 lifted out of contact with the trough deck 164. This position facilitates the flushing of materials from the trough and represents a clean-out mode of operation of the conveyor, such that neither plate impedes flow through the trough.

As piston 154 retracts, arms 140 are rotated in a clockwise direction as viewed in FIGS. 6*a*–6*c* and the bottom edge 166 of weir gate 149 is forced into contact with the trough deck 164. At the point when the weir gate edge 166 first contacts the trough deck 164, the weir gate assembly is in a maximum-bed depth configuration (see FIG. 6*b*), the distance A between edge 136 of weir gate 149 and the trough deck 164 defining the depth of the flow through the trough. In this position, neither of the plates 134 or 146 are deformed from their static configuration.

Continued retraction of piston 154 results in further rotation of arms 140, with weir gate 149 being forced against the trough deck and deforming about L-shaped flange 148, with weir gate edge 136 moving increasingly closer to trough deck 164 and thereby prescribing progressively more shallow flow depths within the trough. As illustrated in FIG. 6*c*, a minimum-bed depth configuration is attained when arms 140 ar sufficiently rotated to bend a portion 168 of plate 146 about the flange 148 into substantially parallel engagement with the trough deck. A portion 170 of plate 134 is bent independently of palte 146 about the flange 148 and into substantially parallel relation with the bent portion 168. In this position, the distance B between edge 136 and the trough deck 164 define a minimumn depth of the flow through the trough.

In order to limit the rotary travel of the arms 140 as the weir assembly 132 is moved between the fully withdrawn, clean-out position shown in FIG. 6*a* and an operable position, with the weir gate edge 166 engaging the trough deck 164 and the position of weir gate edge 136 defining a fluidized bed depth, an arcuate guide plate 170 is disposed adjacent a radial end 172 of arms 140 and has a curved groove 174. A bolt 176 is selectively positioned within the groove and secured thereto by means of a nut 178. As piston 154 is retracted, radial end 172 contacts bolt 176 and the arms 140 and piston 154 are thereby prevented from over-travel. In this way, the depth of the fluidized bed prescribed by the position of the weir gate assembly is accurately limited.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a device for conveying a flow within a fluidized bed of material wherein the flow extends through an elongated trough, an apparatus for regulating the flow, comprising:

a weir gate immersed in the fluidized bed of material having a spaced-apart upper weir edge and lower weir edge; and adjustment means interconnected between the elongated trough and said weir gate for varying the position of the upper weir edge relative to the lower weir edge, said adjustment means having resilient members connected to the weir gate so that elastic deformation of the resilient members establishes the relationship between the upper weir edge and the lower weir edge for regulating the depth of the flow.

2. The device defined in claim 1 having a plurality of weir gates arranged seriatim in the fluidized bed of material for regulating the flow at a plurality of points along the flow path.

3. The device defined in claim 1 including actuator means in driving engagement with the adjustment means for automatically varying the relationship of the upper weir edge to the lower weir edge for regulating the flow.

4. The device defined in claim 3 in which the actuator means for automatically varying the relationship of the upper weir edge to the lower weir edge for regulating the flow comprises a rotary actuator.

5. In a device for conveying a flow within a fluidized bed of material, an apparatus for regulating the flow, comprising:

a resilient weir gate immersed in the fluidized bed and having a spaced-apart upper weir edge and lower weir edge; and adjustment means for varying the position of the upper weir edge relative to the lower weir edge for regulating the flow, wherein elastic deformation of the resilient weir establishes the relationship of the upper weir edge to the lower edge for regulating the flow.

6. A weir gate assembly for regulating a flow of a fluidized bed of material traveling along a flow path on a conveying trough in a housing, the weir gate assembly comprising:

a substantially rectangular weir gate immersed in the fluidized bed of material;

a rotatable arm pivoted to the housing; and resilient links connecting said arm with said weir gate whereby rotating the arm will vary the configuration of the weir gate within the fluidized bed.

7. The weir gate assembly defined in claim 6 in which the weir gate has a spaced-apart upper weir edge and lower weir edge, with the relationship of the upper weir edge to the lower weir edge regulating the depth of the flow.

8. The weir gate assembly defined in claim 7 having guide means for guiding rotation of the rotatable arm.

9. The weir gate assembly defined in claim 8 including clamp means intermediate the rotatable arm and the guide means for maintaining the relationship of the upper weir edge to the lower weir edge.

10. The weir gate assembly defined in claim 9 in which the links interconnecting the weir gate and the material conveying trough comprise deformable members, and wherein rotation of the rotatable arm forces the lower weir edge into sealed engagement with the material conveying trough and deforms the links such that the relationship of the upper weir edge to the lower weir edge is varied to regulate the depth of the flow.

11. The weir gate assembly defined in claim 10 in which the weir gate is a deformable member, and wherein rotation of the rotatable arm forces the lower weir edge into sealed engagement with the material conveying trough and deforms the weir gate such that the relationship of the upper weir edge to the lower weir edge is varied to regulate the depth of the flow.

12. The weir gate assembly defined in claim 7 in which the rotatable arm is movable between an operating position wherein a portion of the weir gate is immersed in the fluidized bed of material to regulate the flow of material and an inoperative position wherein no portion of the weir gate is immersed in the material to facilitate flushing of the conveying trough.

13. The weir gate assembly defined in claim 7 in which the rectangular weir gate is immersed in the fluidized bed of material obliquely to the direction of the flow path.

14. The weir gate assembly defined in claim 13 in which the weir gate is inclined in the direction of the flow path such that material traveling on the conveying trough is directed from the lower weir edge toward the upper weir edge.

15. The weir gate assembly defined in claim 13 in which the weir gate is inclined away from the direction of the flow path such that material traveling on the conveying trough is directed from the upper weir edge toward the lower weir edge.

16. A vibratory conveyor for transporting a fluidized bed of material along a flow path and extending among a plurality of work stations, the conveyor comprising:

an elongated trough extending between an inlet trough end and an outlet trough end, means directing fluid through the trough for creating the fluidized bed of material, with the work stations positioned along the trough;

vibratory means for generating forces sufficient to advance the flow of material from the inlet end of the trough to the outlet end of the trough; and a weir gate assembly mounted on the trough between each work station for regulating the flow of material between adjacent work stations, said weir gate assembly including a substantially rectangular weir gate having a spaced-apart upper weir edge and lower weir edge immersed in the fluidized bed of material and substantially spanning the conveying trough, and a plurality of resilient links urging the weir gate toward the conveying trough.

17. The vibratory conveyor defined in claim 16 including a rotatable arm pivoted to the housing and connected with the links and weir gate for varying the configuration of the weir gate within the fluidized bed of material and wherein rotation of the rotatable arm forces the lower weir edge against the conveying trough and resiliently deforms the links such that the relationship of the upper weir edge to the lower weir edge is varied to regulate the depth of the flow.

18. The vibratory conveyor defined in claim 16 having a plurality of weir gate assemblies disposed one at the beginning of each work station for independently regulating the flow of material at the work stations.

19. The vibratory conveyor defined in claim 17 in which the weir gate assembly has guide means for guiding rotation of the rotatable arm to vary the relationship of the upper weir edge to the lower weir edge for regulating the flow of material at the work stations, and clamp means intermediate the rotatable arm and the guide means for maintaining the relationship of the upper weir edge to the lower weir edge.

20. A vibratory conveyor for transporting material along a flow path within a housing having a plurality of successive work stations, the conveyor comprising:

an elongated trough extending between an inlet end and an outlet end of the housing, with the work stations positioned therebetween;

vibratory means on the housing for generating forces sufficient to advance the flow of material from the inlet end of the housing to the outlet end of the housing;

means for forcing air through the trough and into the material to generate a fluidized bed of material;

a weir gate assembly mounted on the housing including a rectangular weir gate having a spaced apart upper weir edge and lower weir edge immersed in the fluidized bed of material, a pivot shaft on the housing having resilient links rotatably connected to the weir gate; and a rotatable arm mounted on the pivot shaft for operating the weir gate whereby pivoting the arm will vary the relationship of the upper weir edge to the lower weir edge to regulate the depth of the fluidized bed of material between adjacent work stations.

21. The weir gate assembly defined in claim 20 in which the weir gate is immersed in the flow obliquely to the direction of the flow path and is inclined in the direction of the flow path such that material travelling on the conveying trough is directed from the lower weir edge toward the upper weir edge.

22. The vibratory conveyor defined in claim 20 having a plurality of weir gate assemblies disposed one between adjacent work stations for independently regulating the flow from one work station to the next downstream work station.

23. The vibratory conveyor defined in claim 20 including actuator means for remotely adjusting the configuration of the weir gates.

24. The vibratory conveyor defined in claim 23 having a plurality of weir gates disposed one at the beginning of each work station and independent actuator means associated with each weir gate assembly for independently regulating the flow of material between adjacent work stations.

25. A weir gate assembly for regulating a flow of a fluidized bed of material traveling along a flow path on a conveying trough in a housing, the weir gate assembly comprising:

a rotatable arm pivoted to the housing;

a weir gate mounted on said rotatable arm and immersed in the fluidized bed of material, whereby rotating the arm will vary the configuration of the weir gate within the fluidized bed, said weir gate comprising a plurality of substantially rectangular plates having connection means interposed therebetween, each of the plates being independently deformable to regulate the depth of the flow.

26. The weir gate assembly defined in claim 25 in which the connection means comprises an L-shaped flange having first and second perpendicar legs, with each one of a pair of adjacently posed substantially rectangular plates being mounted on one leg of the flange.

27. The weir gate assembly defined in claim 25 in which the weir gate comprises two interconnected substantially rectangular plates, one of the plates having an upper edge mounted to an outer end of the rotatable arm and the other of the plates having a lower edge engaging the trough, with the distance between the upper edge and the lower edge defining a fluidized bed depth within the trough.

28. The weir gate assembly defined in claim 25 having guide means for defining a limit of rotation for the rotatable arm.

29. The weir gate assembly defined in claim 27 including clamp means intermediate the rotatable arm and the guide means for maintaining the position of the limit of rotation for the rotatable arm.

30. The weir gate assembly defined in claim 25 in which the substantially rectangular plates comprise deformable members, and wherein rotation of the rotatable arm forces a portion of one plate into sealed engagement with the material conveying trough and deforms the plates such that the relationship of one plate to another plate is varied to regulate the depth of the flow.

31. The weir gate assembly defined in claim 30 in which the rotatable arm is movable between an operating position wherein a portion of the weir gate is immersed in the fluidized bed of material to regulate the flow of material and an inoperative position wherein no portion of the weir gate is immersed in the material to facilitate flushing of the conveying trough.

32. The weir gate assembly defined in claim 30 in which the rotatable arm is movable between a first operating position wherein a lower edge of the weir gate engages the trough and none of the plates are deformed to specify a minumum depth of the flow, and a second operating position wherein a lower portion of the weir gate engages the trough with each of the plates deformed to specify a maximum depth of the flow.

* * * * *